US006892911B2

(12) United States Patent
Hamazaki

(10) Patent No.: US 6,892,911 B2
(45) Date of Patent: May 17, 2005

(54) NEEDLE THREADER

(75) Inventor: Koichi Hamazaki, Borough of Bedminster, County of Somerset, NJ (US)

(73) Assignee: Around The House LLC, Bedminster, NJ (US)

( * ) Notice: Subject to any disclaimer, the term of this patent is extended or adjusted under 35 U.S.C. 154(b) by 0 days.

(21) Appl. No.: 10/339,682

(22) Filed: Jan. 9, 2003

(65) Prior Publication Data

US 2004/0155073 A1 Aug. 12, 2004

(51) Int. Cl.[7] ..... D05B 88/00
(52) U.S. Cl. ..... 223/99
(58) Field of Search ..... 223/99; 7/135

(56) References Cited

U.S. PATENT DOCUMENTS

| | | | | |
|---|---|---|---|---|
| 1,241,427 A | | 9/1917 | Nielsen | |
| 1,278,995 A | | 9/1918 | Petro | |
| 2,042,403 A | | 2/1936 | Hrivnak | |
| 2,059,680 A | | 11/1936 | Carlson | |
| 2,090,678 A | * | 8/1937 | Jauch | 223/99 |
| 2,411,118 A | | 11/1946 | Schuster | |
| 2,416,260 A | | 2/1947 | Karle | |
| 2,476,872 A | | 7/1949 | Jamo | |
| 2,507,370 A | * | 5/1950 | Edwards | 223/99 |
| 2,800,262 A | * | 7/1957 | Appel | 223/99 |
| 4,090,649 A | | 5/1978 | Cichinski | |
| 4,102,478 A | | 7/1978 | Samoilov | |
| 4,461,409 A | | 7/1984 | Biemans | |
| 4,667,860 A | | 5/1987 | Feuerman | |
| 4,930,871 A | | 6/1990 | Tannahill | |
| 5,988,463 A | | 11/1999 | DiCarlo | |

* cited by examiner

*Primary Examiner*—John J. Calvert
*Assistant Examiner*—James G Smith
(74) *Attorney, Agent, or Firm*—Kenneth P. Glynn

(57) ABSTRACT

A needle threader device includes: a loop support base; a threading loop connected to the loop support base; a needle holder base; a needle cradle located on the needle holder base; a loop passage guide located on the needle holder base and intersecting the needle cradle at a predetermined angle, and being biased toward one end of the needle cradle; and, a thread insertion hole located on the needle holder base, adjacent to and connected to the loop passage guide. The loop support base and the needle holder base and rotatably connected so that the threading loop may be inserted into the guide and extended into the thread insertion hole. A user may insert a needle into the needle cradle with the needle eye located at the intersection of the needle cradle and the loop passage guide, then move the loop support base toward the needle holder base so as to insert the threading loop into the loop passage guide, through the eye of the needle and into the thread insertion hole. The user may then insert thread through the thread insertion hole and the threading loop, and then move the loop support base away from the needle holder base so as to withdraw the threading loop from the thread insertion hole, from the eye of said needle, and from the loop passage guide so as to thread the needle.

19 Claims, 8 Drawing Sheets

NEEDLE THREADER

BACKGROUND OF THE INVENTION

1. Field of the Invention

The present invention relates to needle threaders, and more particularly, to needle threaders that operate manually, but automatically, in that alignment and motion are predefined. Further, the present invention needle threaders are easy to use and provide for threader loop storage on the device itself to mitigate loop damage. The present invention needle threaders are stand alone devices, or are complementary to other functions, e.g., scissors, and are self-contained in a single unit. The present invention devices eliminate needle holding, eliminate loop and thread alignment problems, eliminate loop and needle alignment and loop and needle insertion problems and are extremely simple and efficient to operate.

2. Information Disclosure Statement

The following patents illustrate the history and state-of-the-art of threading needles:

U.S. Pat. No. 1,241,427 describes a needle threader comprising a magnify glass, a suitable holder for the glass to protect its surface from injury, and a foldable member secured to the holder adapted to present a socket for a needle in a line lying in the focal plane of the magnifying glass.

U.S. Pat. No. 1,278,995 describes the combination of a pair of shears having a pair of handles adapted to be grasped in the hand, of a frame carried upon one of the handles, and of a magnifying lens mounted in said frame. The frame extends at an angle to the plane of the handles of the shears sufficient to aline the longitudinal focal axis of the lens on an object held between the fingers supporting the shears.

U.S. Pat. No. 2,042,403 describes a needle threader comprising a hollow handle having parallel side walls, said walls having longitudinally extending slots therein, a double headed button having the shank portion extending through the slots and slidable therein, a thin gage wire bent upon itself with the portion adjacent the bight being parallel and adjacent each other, the remaining portions of the wire being further spaced apart and parallel, with the free ends thereof secured to the shank portion of the button, the wire and handle being relatively proportioned whereby the wire may be entirely confined in the handle.

U.S. Pat. No. 2,059,680 describes a needle threader comprising a wire loop having a central, relatively open part and a terminal bend, and a plate fastened to and underlying said loop, said plate having a first aperture therein underlying said central part of said loop and having a second aperture therein underlying said bend in said loop.

U.S. Pat. No. 2,411,118 describes a needle threader and of the type known as the wire loop threaders, comprising a suitable handle having a affixed to same a fine spring metal flexible wire loop said loop consisting of a single piece of wire and formed as a polygon providing when permanently attached to the handle a closed loop with a centrally disposed open area; various length members forming laterally two obtuse angles of unequal size but whose apices are not situated directly opposite each other so that entering and again leaving a needle eye that apices will smoothly follow one another and not attempt to pass through the eyes simultaneously, thusly producing a device which will be more efficient in use, being stronger and allowing the use of finer threads in the finer needle eyes.

U.S. Pat. No. 2,416,260 describes a device for use in conjunction with a surgical stitching instrument comprising a rod-like member having, at one end, a needle threading element adapted to thread the needle of the instrument and at its opposite end a curved and tapered portion affording a hook having, on its cave side, a notch adapted to engage and draw out from flesh tissue the free end of a limb of a thread-loop passed through said tissue by the needle, and guard means on said member shiftable to a position in which it prevents accidental contact with said needle-threading element and constitutes an extended handle for said loop-engaging portion.

U.S. Pat. No. 2,476,872 describes a needle threader for use with a needle having an eye near the point and a needle clamp for the other end of the needle, said threader comprising a body member having a horizontal body portion and a vertically extending horn at the forward end thereof, a plunger disposed in a horizontal bore in the horizontal body portion, a vertical needle seat in the horn and the body portion and extending from the upper end of the horn to the forward end of said bore, said body member having a thread seat at the forward end of the bore extending rearwardly of the needle seat and having downwardly flaring thread guides disposed at the lower end of the horn for directing a thread into the thread seat, the upper end of said horn being spaced from the path of the plunger a distance equal to the distance from the clamp to the needle's eye so that contact of the upper end of the horn with the needle clamp automatically positions the seated needle with the eye thereof in the path of said plunger.

U.S. Pat. No. 4,090,649 describes a needle threader including a magnetic pin which is used to find the eye of the needle and is inserted therein. The threader also includes a hook like member which is of a magnetic material and which is pulled through the eye of the needle by the magnetic pin. Once the threader is pulled through the eye of the needle, a thread is inserted therein, and when the threader is pulled out of the eye, the thread is caught in the eye, and the needle is threaded.

U.S. Pat. No. 4,102,478 describes an improved needle-threading device disclosed wherein a wire loop, having a smaller loop disposed in the medial portion, is rigidly sandwiched at double hook-shaped end portions between an outer support member and an inner support member. The outer and inner support members are tubular with the inner member fitting within the outer member and engaging the double hook-shaped end portions of the wire loop, thereby holding the wire loop rigidly in place and furnishing a convenient handle with which to hold the needle-threading apparatus during use.

U.S. Pat. No. 4,461,409 describes a threader for a mounted sewing machine needle having an eye adjacent the pointed lower end thereof includes a base plate adapted to be received beneath the foot of the machine, and a housing providing a positioning recess for aligning the needle threader with sewing machine needle eye. The housing supports a pair of reciprocable thread pusher members at right angles to one another, and when the device is aligned with the needle eye, the first pusher member is displaceable from a retracted to an extended position to push a strand of thread through the needle eye from one side thereof to the other. When the first pusher member is returned to the retracted position, the second thread pusher member is displaceable from a retracted to an extended position to engage a loop of thread on the other side of the needle eye and to displace the thread laterally of the needle to a position where it can be easily grasped by the user's fingers.

U.S. Pat. No. 4,667,860 describes a sewing needle that has a closed loop of resilient filament secured to its rear end.

In unstressed condition the filament has an open configuration allowing a sewing thread to be easily passed through it. As the needle is pulled through fabric the loop collapses under the forces imposed on its sides by the fabric.

U.S. Pat. No. 4,930,871 describes a needle threader for facilitating the insertion of an end of a thread in the eye of a needle. In one embodiment the threader has a magnifying lens mounted in a holder which is secured to a flexible mount having a ring portion for a person's finger and a wax holder for holding wax to be applied to the end of the thread. In another embodiment such a threader has a colored background contrast member for making it easier to see the thread. This contrast member can be secured to the lens holder or to the flexible mount. In another embodiment a needle threader is provided which has a magnifying lens with a holder and a background contrast member. A background contrast member for a magnifying lens is also provided.

U.S. Pat. No. 5,988,463 describes a needle threader for yarn or other bulky materials that is used in needle work having a projecting loop provided with a substantial planar surface to accommodate the strands of the yarn and thereby reducing frictional resistance as the yarn is passed through the eye of the needle. The needle threader is provided with a cutter for the yarn on the same handle utilized by the threader.

Notwithstanding the prior art, the present invention is neither taught nor rendered obvious thereby.

SUMMARY OF THE INVENTION

The present invention is a needle threader that involves two primary components (bases) that are hingedly and rotatably connected to one another, i.e. they are rotatable at least through an arc, relative to one another. The bases function like a pocket knife and, in some preferred embodiments, like a pair of scissors. In other embodiments, the device is actually embodied within a pair of scissors. On one base is located a threading loop and, on the other, a needle holder or cradle. There is also a threading loop passage guide located on the base with the needle cradle, as well as a thread insertion hole.

Thus, the present invention needle threader device includes:

(a). a loop support base;

(b). a threading loop connected to the loop support base;

(c). a needle holder base;

(d). a needle cradle located on the needle holder base;

(e). a loop passage guide located on the needle holder base and intersecting the needle cradle at a predetermined angle, and being biased toward one end of the needle cradle; and, (f). a thread insertion hole located on the needle holder base, adjacent to and connected to the loop passage guide.

The loop support base and the needle holder base are moveably connected to one another so that the threading loop may be inserted into the loop passage guide and extended into the thread insertion hole by movement of the loop support base toward the needle holder base.

A user may insert a needle into the needle cradle with the needle eye located at the intersection of the needle cradle and the loop passage guide, the user may then move the loop support base toward the needle holder base so as to insert the threading loop into the loop passage guide, through the eye of the needle and into the thread insertion hole. The user may then insert thread through the thread insertion hole and through the threading loop, and the user may then move the loop support base away from the needle holder base so as to withdraw the threading loop from the thread insertion hole, from the eye of the needle, and from the loop passage guide so as to thread the needle with the thread.

In some embodiments, the loop support base and the needle holder base are moveably connected to one another at a single pivot point for rotational movement to and away from each other in an arcuated fashion, similar to a pocket knife or a pair of scissors. The loop support base and the needle holder base are generally both elongated bases, each having a first end and a second end, and are connected to each other at their second ends. The first end of the loop support base and the first end of the needle holder base include handle portions, and may have grips, thumb/finger holes, etc.

Generally the threading loop is connected to the loop support base via a loop arm having a first end connected to the loop support base, and having a second end connected to the threading loop. The loop arm is preferably rotatably connected to the loop support base, so as to provide for movement of the loop arm and threading loop to and from an open position and a closed positions. Preferably, the loop support base includes a protective sheath member to shield the threading loop when the loop arm and threading loop are in the closed position, as well as a recess to add further protection.

Loop passage guide may intersect the needle cradle at an angle of at least 45°, and preferably at an angle of about 75° to 105°. Around 90° or so is preferred.

There may be a finger cut out at the needle cradle to enhance insertion and removal of a needle therefrom. Further, the needle cradle may be magnetized to aid in holding a needle.

In other embodiments, the present invention needle threader includes:

a pair of scissors having a first member and a second member rotatably connected to one another at a pivot point. The pivot point is approximately in the middle, and each member has a handle end and a cutting end separated by the pivot point. The cutting ends each have a cooperating cutting edge, and the scissors further includes:

(a). the first member handle end also being a loop support base;

(b). a threading loop connected to the loop support base;

(c). the second member handle end also being a needle holder base;

(d). a needle cradle located on the needle holder base;

(e). a loop passage guide located on the needle holder base and intersecting the needle cradle at a predetermined angle, and being biased toward one end of the needle cradle; and, (f). a thread insertion hole located on the needle holder base, adjacent to and connected to the loop passage guide;

The loop support base and the needle holder base are moveably connected to one another via the pivot point of the scissors so that the threading loop may be inserted into the loop passage guide and extended into the thread insertion hole by movement of the loop support base toward the needle holder base. The user proceeds as described above in earlier embodiments, and, when the swing arm and loop are stored, has the added advantage of a pair of scissors in hand.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
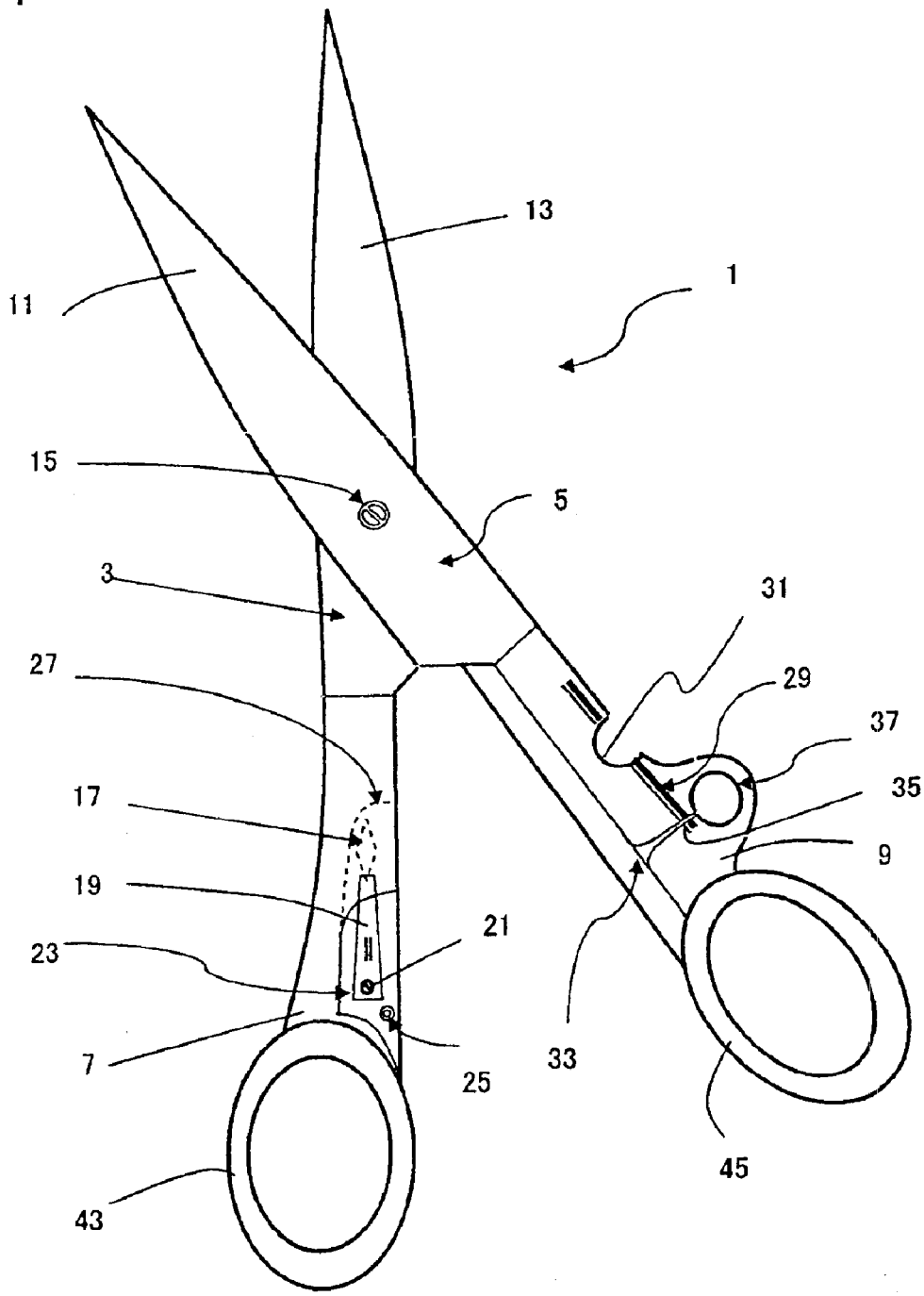
FIG. 1 shows a top view of a present invention needle threader device that includes scissors features.

FIG. 1 illustrates one preferred embodiment present invention needle threader device 1, in this case, a pair of scissors as well. Device 1 has a loop support base 3 and a needle holder base 5. Loop support base 3 has a handle end 7 and a cutting end 13. Likewise, needle holder base 5 has a handle end 9 and a cutting end 11. The loop support base 3 and the needle holder base 5 are pivotally (rotatably) connected to one another at a pivot point established by screw 15. Screw 15 could be a screw pin, a screw and nut, a rivet or any other hinging element used for scissors.

In this embodiment, cutting ends 11 and 13 and the areas around screw 15 up into handle ends 7 and 9 are formed of metal, e.g. stainless steel, and the remainder of the handle ends are made of molded plastic. Choice of materials of construction are within the purview of the artisan, and any functional materials of construction are within the scope of the present invention.

Figure 2A:
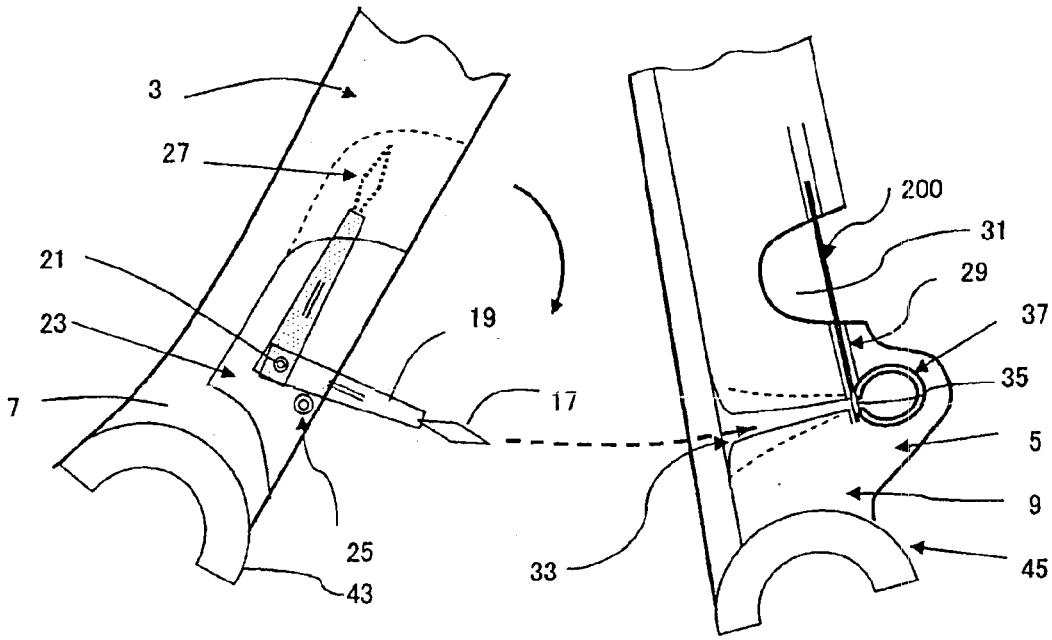
FIGS. 2*a* and 2*b* show enlarged, partial cut top views of the FIG. 1 device in operation.
Figure 2B:
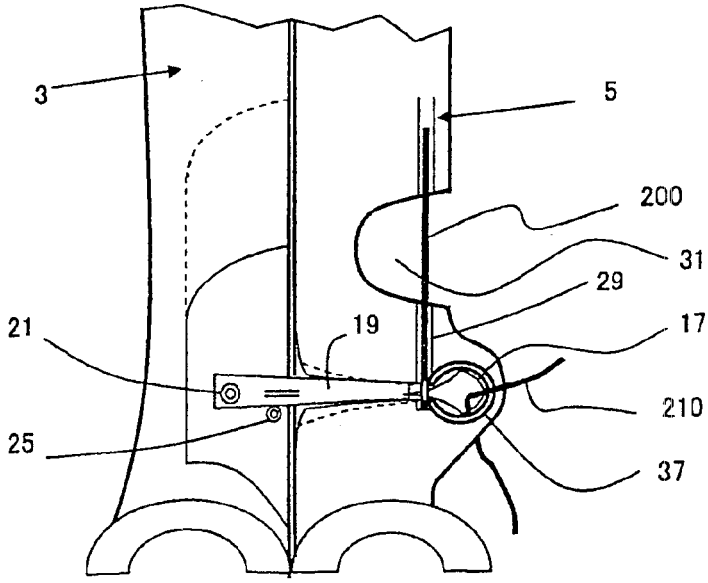
Figure 4:
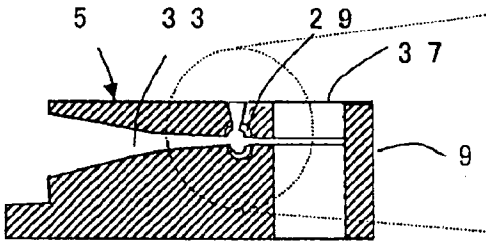
Figure 3:
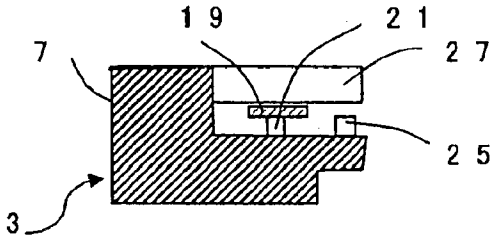
Figure 7:
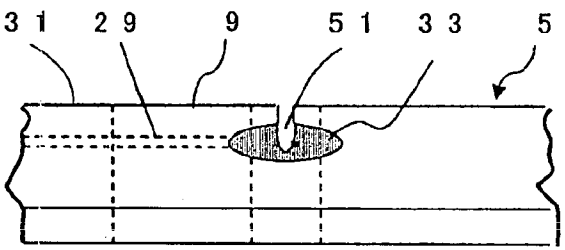
FIGS. 6 and 7 show partial side views thereof.
Figure 8:
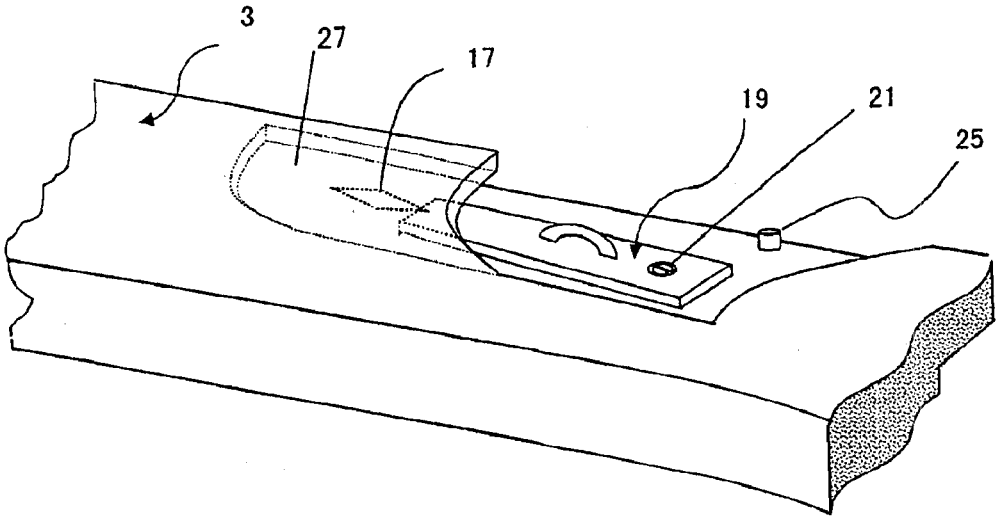
FIG. 8 shows a partial oblique vie w of the loop support base shown above and FIG. 9 shows a partial oblique view of the needle holder base shown above.
Figure 9:
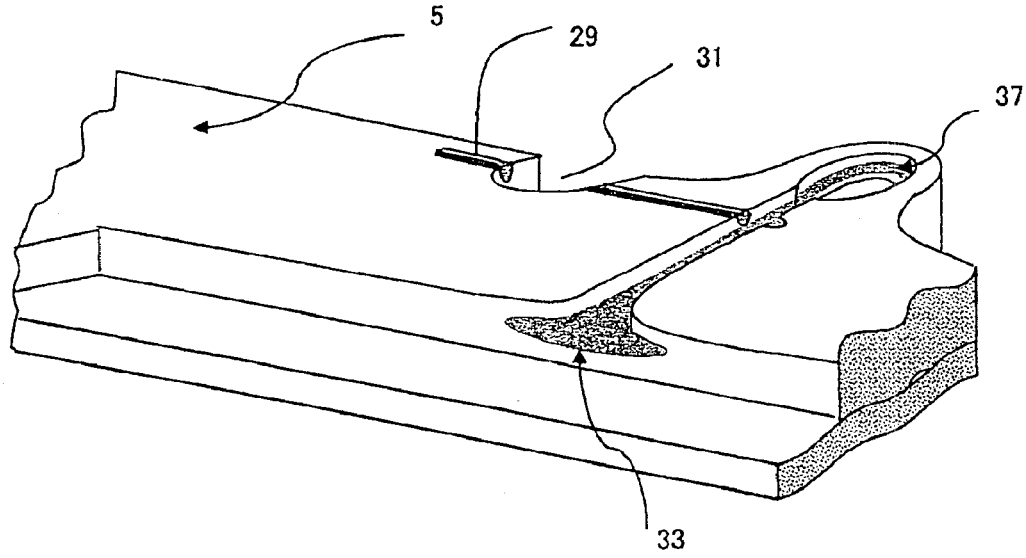

FIG. 2*a* shows a partial cut view of handle portions 7 of loop support base 3 and handle portion 9 of needle holder base 5, in the open position; and FIG. 2*b* shows the same elements in the closed, needle threading position. FIGS. 3 and 4 show end cut views of the handle ends 7 and 9 of the device 1, shown above, and FIG. 5 shows an exploded view of the needle cradle and loop passage guide intersection shown in FIG. 4. FIGS. 6 and 7 show partial side views of handle ends 7 and 9 of device 1, and FIGS. 8 and 9 show perspective partial cut views of handle ends 7 and 9. Reference is now made to FIGS. 1, 2*a*, 2*b*, 3, 4, 5, 6, 7, 8, and 9 collectively, wherein identical elements are identically numbered.

Handle end 7 of loop support base 3 includes a threading loop 17 and swing arm 19, wherein loop 17 may be replaceable, either by removing both the swing arm and its loop and attaching a new one, or by removing loop 17 from swing arm 19 and replacing it. (This is an optional feature that may be useful in the instances where the loop 17 is accidentally bent beyond use or breaks.) Swing arm 19 and loop 17 are pivotally connected to handle portion 7 via screw or pin 21. There is a nesting recess 23, so that swing arm 19 with loop 17 may be stored therein. Optional, but beneficial, loop sheath 27 is provided for concealing and protecting threading loop 17 when not in use. When in use, arm 19 is swung out to stop 25, where it and loop 17 are properly positioned for insertion of arm 19 and loop 17 into loop passage guide 33 of handle end 9 of needle holder base 5.

Handle end 9 includes a loop passage guide 33, a needle cradle 29, a cut out 31 for grasping the needle during insertion into and removal from the needle cradle 29, and a threading hole 37. Needle cradle 29 intersects loop passage guide 33 toward one end of needle cradle 29, as shown, so that a needle inserted therein will have the needle eye aligned with the loop inserted into the passage guide so as to effect the passage of the loop 17 through a needle eye. Actual use is now described:

Needle 200 is inserted into cradle 29 with its eye at insertion 37. The contour of cradle 29 is formed to encourage needle eye alignment, both axially and laterally. The area of the intersection and/or other portions cradle are desirably magnetized, e.g., with magnet 53, to hold needle 200 in place after insertion. Swing arm 19 with loop 17 is swung open to stop 25. Maintaining a normal finger hole hold view via finger nests 43 and 45, a user, next brings the handle ends 7 and 9 towards one another, so that loop 17 moves through loop passage guide 33, wherein it is constricted, through the eye of needle 200 and into threading hole 37. In threading hole 37, loop 17 opens up to its diamond shape. Thread 210 is partially passed through loop 17 (FIG. 2*b*) and is rested therein. The user now opens (separates) handle ends 7 and 9 from one another. This automatically pulls loop 17 with thread 210 back through the eye of needle 200, to effectively thread the needle. The needle 200 and its threaded thread 210 are removed from cradle 29 for subsequent use. Arm 19 and loop 17 are swung back into recess 23 and sheath 27 for storage. The device 1 may conveniently be used as a pair of scissors when arm 19 and loop 17 are stored.

Figure 10:
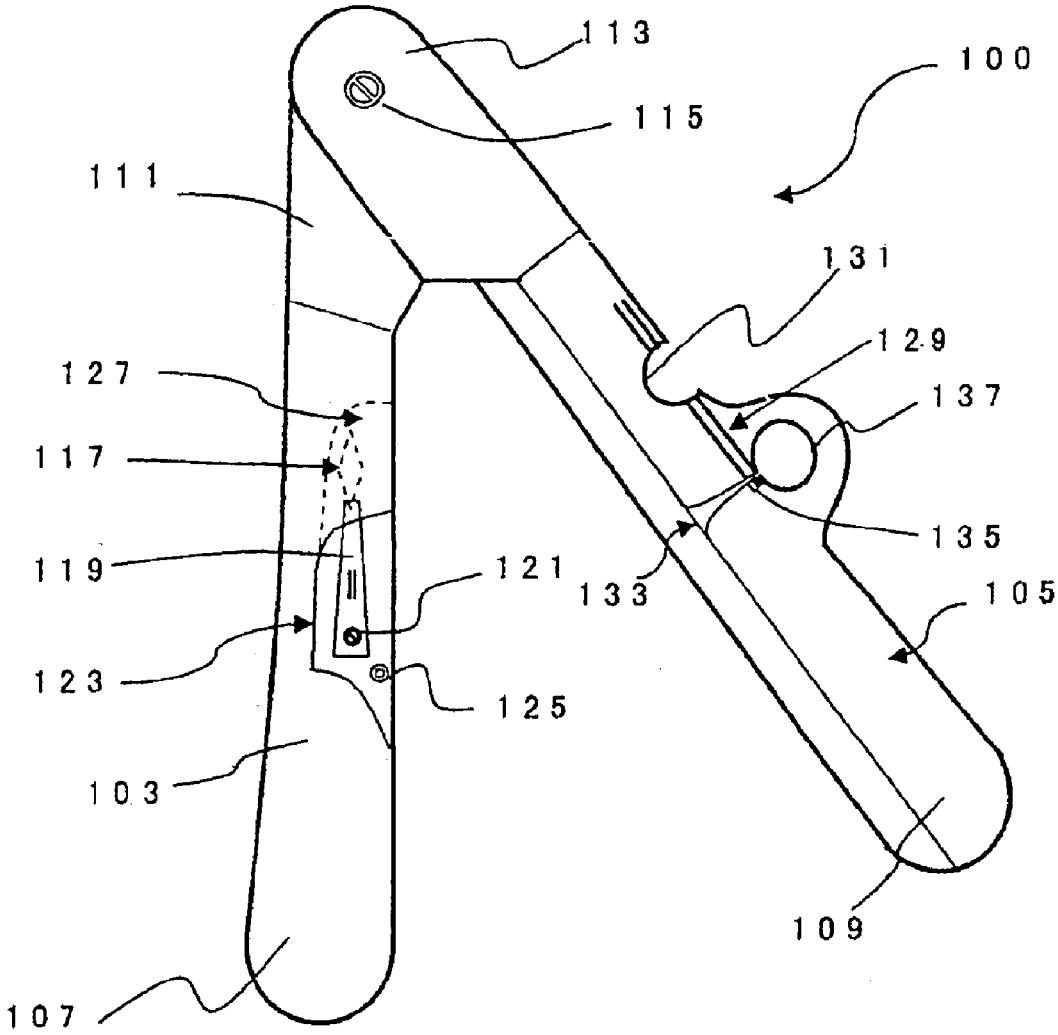
FIG. 10 shows a top view of another present invention needle threader device that is a stand alone device.

Alternative embodiment present invention device 100 is shown in FIG. 10. This threader device 100 has no cutting ends and is not a scissor. It is a compact, stand alone device for easy hand use and convenient storage with sewing supplies. It may be stored as is, or in a convenient cloth or plastic case.

Device 100 includes a first member, being a loop support base 103, and a second member, being a needle holder base 105. Loop support base has first end 111 and a second end 107. Likewise, needle holder base 105 has a first end 113 and a second end 109. Device 100 has loop support base 103 and needle holder base 105 rotatably connected to one another a first ends 111 and 113 via screw 115. Second ends 107 and 109 act as handless to be brought together and apart during use, as described below.

Loop support base 103 includes a threading loop 117 and swing arm 119, wherein loop 117 may be replaceable, either by removing both the swing arm and its loop and attaching a new one, or by removing loop 117 from swing arm 119 and replacing it. Swing arm 119 and loop 117 are pivotally connected to base 103 via screw or pin 121. There is a nesting recess 123, so that swing arm 119 with loop 117 may be stored therein. Sheath 127 is provided for concealing and protecting threading loop 117 when not in use. When in use, arm 119 is swung out to stop 125, where it and loop 117 are properly positioned for insertion of arm 119 and loop 117 into loop passage guide 133 of needle holder base 105.

Needle holder base 105 includes a loop passage guide 133, a needle cradle 129, a cut out 131 for grasping the needle during insertion into and removal from the needle cradle 129, and a threading hole 137. Needle cradle 129 intersects loop passage guide 133 toward one end of needle cradle 129, as shown, so that a needle inserted therein will have the needle eye aligned with the loop inserted into the passage guide so as to effect the passage of the loop 117 through a needle eye. Actual use is identical to that described above with respect to FIGS. 1 through 9.

Figure 5:
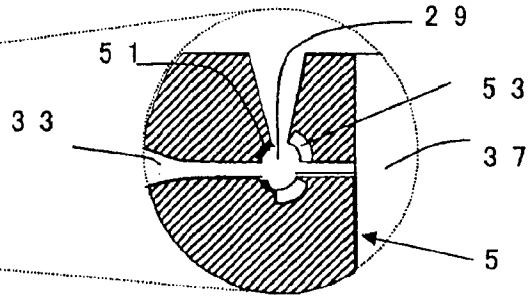
FIGS. 3, 4, and 5 show end cut views of the loop support base and needle holder base shown in the above Figures.
Figure 6:
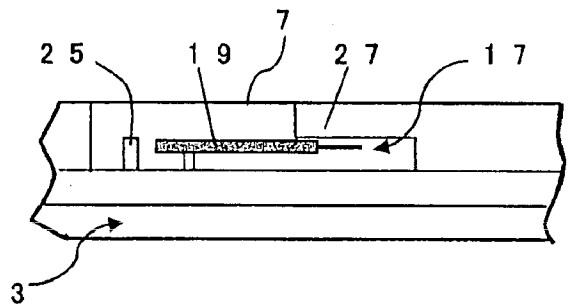

The needle cradles of the embodiments above and below are preferably magnetized, as shown in FIG. 5 above. Also, the length of the needle cradle may be longer than a typical sewing kit needle to accommodate different size needles.

Figure 11:
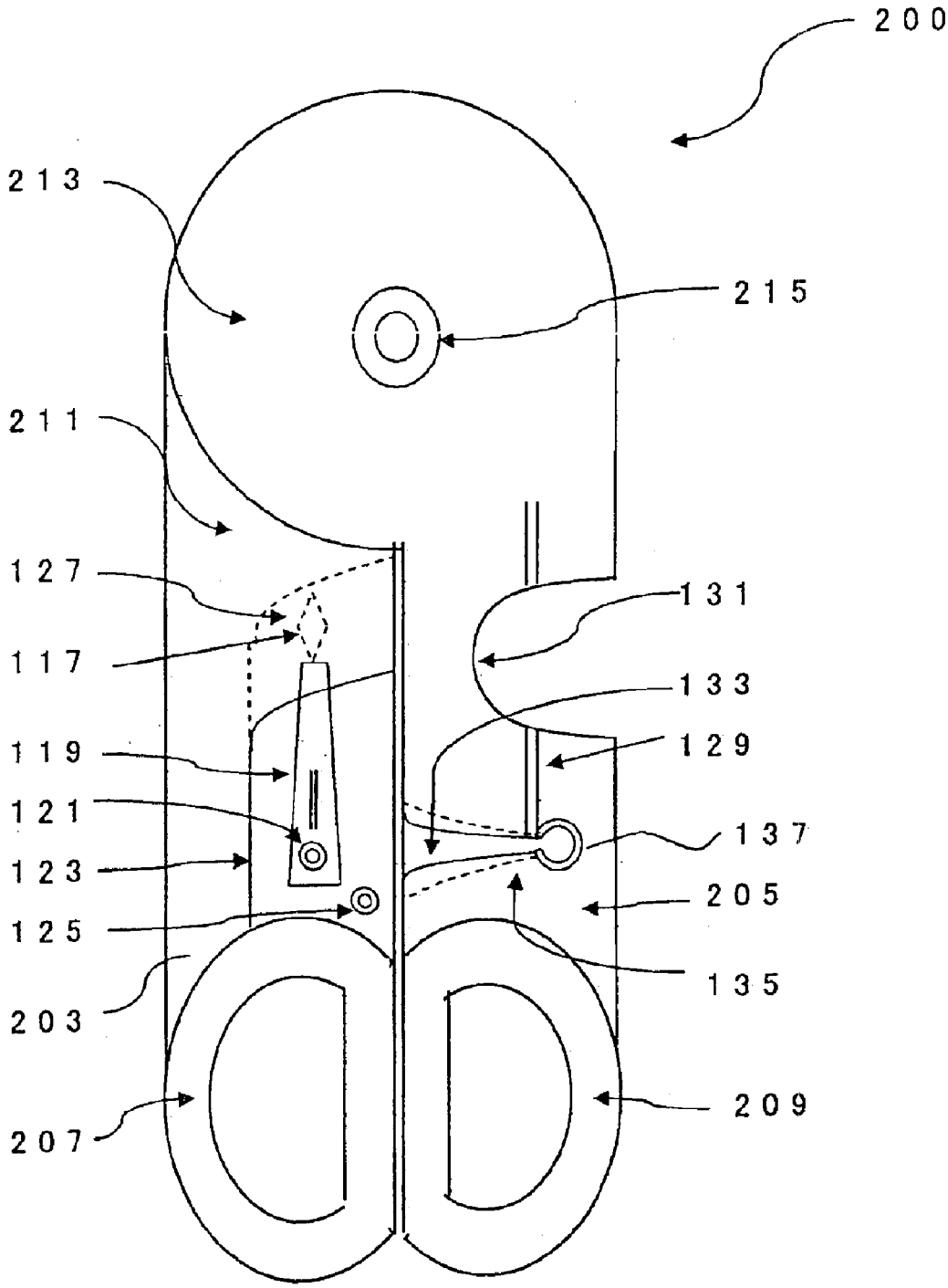
FIG. 11 illustrates a top view of a present invention device similar to the FIG. 10 device, with added features; and, FIGS. 12 and 13 show a side view and an oblique view of an alternative present invention device adapted for use with a sewing machine.

FIG. 11 shows another embodiment of the present invention device wherein it is similar to device 100 above, with identical parts so numbered, but has a first member base 203 with a wider body and circular pivot end 211 and a thumb nest hole 207, and has a second member base 205 with a wider body and circular pivot 213 and a finger nest hole 209, as shown. Since the other elements are the same as shown in FIG. 10 above, there description and function need not be repeated. The only significant difference involves thumb and finger insertions in this embodiment.

Figure 12:
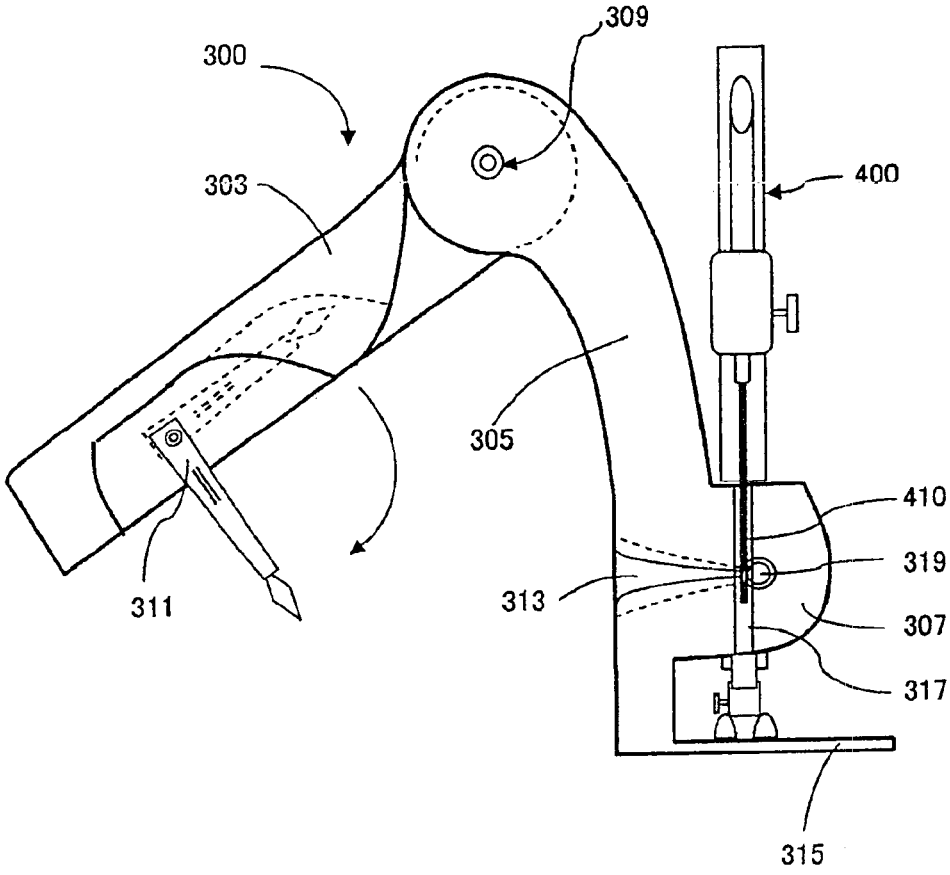
Figure 13:
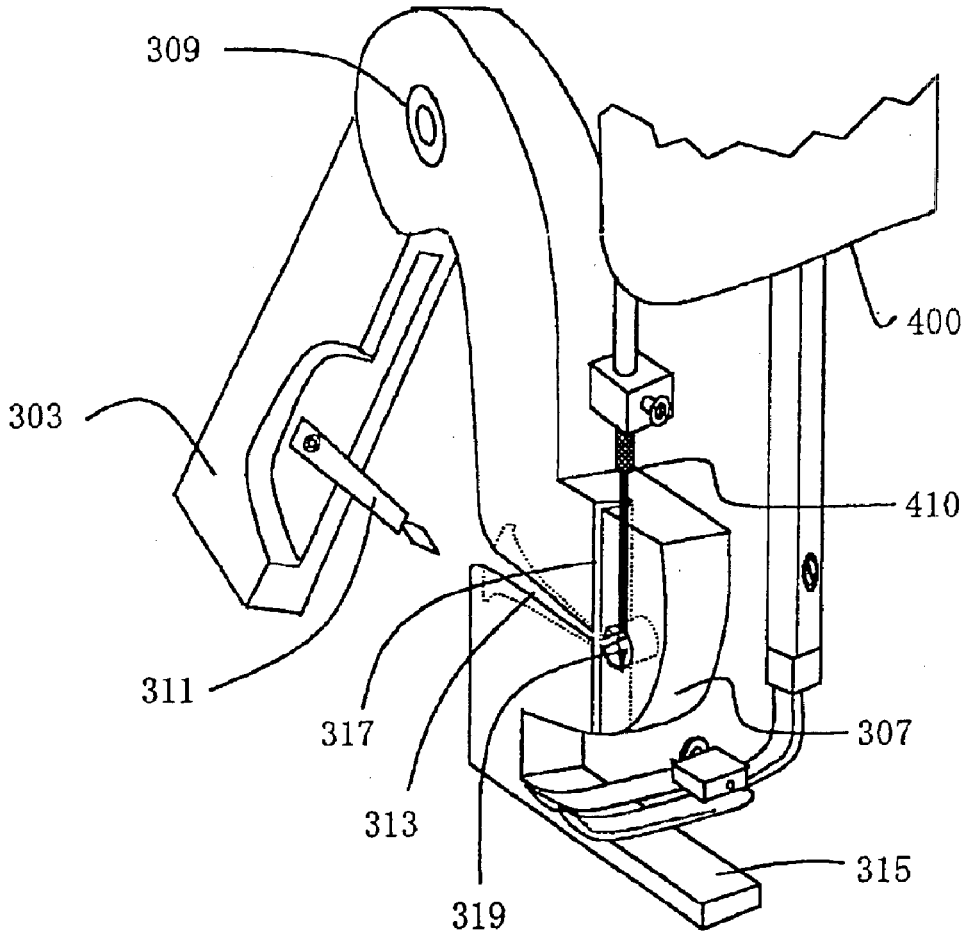

FIGS. 12 and 13 illustrate a present invention embodiment adapted for use with sewing machines. Hence, threader device 300 has a first member 303 rotatably connected to a second member 305 via rivet 309. First member 303 includes a swing arm and loop similar to those described above, shown generally as loop component 311. Second member 305 includes an extended section 307 and includes a loop guide, needle cradle and threading orifice similar to those shown above, shown generally as guide 313, needle cradle 317 and threading orifice 319. There is a flat support base 315 at the bottom of second member 305 for placement on a sewing machine base. Sewing machine 400 is partially shown with needle 410 located within needle cradle 317 for threading. The thread is taken from a spool into orifice 319 and the device 300 then works in a manner as described above for the previous Figure devices.

Obviously, numerous modifications and variations of the present invention are possible in light of the above teachings. It is therefore understood that within the scope of the appended claims, the invention may be practiced otherwise than as specifically described herein.

What is claimed is:

1. A needle threader, which comprises:

a pair of scissors having a first member and a second member rotatably connected to one another at a pivot point, each member having a handle end and a cutting end separated by said pivot point, said cutting end having a cooperating cutting edge, wherein said scissors further includes:

(a). said first member handle end also being a loop support base;

(b). a threading, loop connected to said loop support base;

(c). said second member handle end also being a needle holder base;

(d). a needle cradle located on said needle holder base;

(e). a loop passage guide located on said needle holder base and intersecting said needle cradle at a predetermined angle, and being biased toward one end of said needle cradle; and, (f). a thread insertion hole located on said needle holder base, adjacent to and connected to said loop passage guide;

said loop support base and said needle holder base being moveably connected to one another via said pivot point of said scissors so that said threading loop may be inserted into said loop passage guide and extended into said thread insertion hole by movement of said loop support base toward said needle holder base; and, such that a user may insert a needle into said needle cradle with the needle eye located at the intersection of said needle cradle and said loop passage guide, the user may then move said loop support base toward said needle holder base by closing said scissors handle ends so as to insert said threading loop into said loop passage guide, through said eye of said needle and into said thread insertion hole, the user may then insert thread through said thread insertion hole and through said threading loop, and the user may then move said loop support base away from said needle holder base by opening said scissors handle end so as to withdraw said threading loop from said thread insertion hole, from said eye of said needle, and from said loop passage guide so as to thread said needle with said thread.

2. The needle threader of claim 1 wherein said threading loop is connected to said loop support base via a loop arm having a first end connected to said loop support base, and having a second end connected to said threading loop.

3. The needle threader of claim 2 wherein said loop arm is rotatably connected to said loop support base, so as to provide for movement of said loop arm and threading loop to and from an open position and a closed position.

4. The needle threader of claim 3 wherein said loop support base includes a protective sheath member to shield said threading loop when said loop arm and threading loop are in said closed position.

5. The needle threader of claim 1 wherein said loop passage guide intersects said needle cradle at an angle of at least 45°.

6. The needle threader of claim 5 wherein said loop passage guide intersects said needle cradle at an angle of about 75° to 105°.

7. The needle threader of claim 1 wherein said loop passage guide intersects said needle cradle at approximately 90°.

8. The needle threader of claim 1 wherein said needle cradle includes a finger cut out to enhance removal of a needle therefrom.

9. The needle threader of claim 1 wherein said needle cradle is magnetized to aid in holding a needle.

10. A needle threader, which comprises:

(a) a loop support base;

(b) a threading loop connected to said loop support base;

(c) a needle holder base;

(d). a needle cradle located on said needle holder base;

(e). a loop passage guide located on said needle holder base and intersecting said needle cradle at a predetermined angle, and being biased toward one end of said needle cradle; and, (f). a thread insertion hole located on said needle holder base, adjacent to and connected to said loop passage guide;

said loop support base and said needle holder base being moveably connected to one another so that said threading loop may be inserted into said loop passage guide and extended into said thread insertion hole by movement of said loop support base toward said needle holder base; and, such that a user may insert a needle into said needle cradle with the needle eye located at the intersection of said needle cradle and said loop passage guide, the user may then move said loop support base toward said needle holder base so as to insert said threading loop into said loop passage guide, through said eye of said needle and into said thread insertion hole, the user may then insert thread through said thread insertion hole and through said threading loop, and the user may then move said loop support base away from said needle holder base so as to withdraw said threading loop from said thread insertion hole, from said eye of said needle, and from said loop passage guide so as to thread said needle with said thread; and, further, wherein said loop support base and said needle holder base are moveably connected to one another at a single pivot point for rotational movement to and away from each other in an arcuated fashion; and; wherein said loop support base and said needle holder base are both elongated bases, each having a first end and a second end, and are connected to each other at said second ends.

11. The needle threader of claim 10 wherein said first end of said loop support base and said first end of said needle holder base include handle portions.

12. The needle threader of claim 10 wherein said threading loop is connected to said loop support base via a loop arm having a first end connected to said loop support base, and having a second end connected to said threading loop.

13. The needle threader of claim 12 wherein said loop arm is rotatably connected to said loop support base, so as to provide for movement of said loop arm and threading loop to and from an open position and a closed position.

14. The needle threader of claim 13 wherein said loop support base includes a protective sheath member to shield said threading loop when said loop arm and threading loop are in said closed position.

15. The needle threader of claim 10 wherein said loop passage guide intersects said needle cradle at an angle of at least 45°.

16. The needle threader of claim 15 wherein said loop passage guide intersects said needle cradle at an angle of about 75° to 105°.

17. The needle threader of claim 10 wherein said needle cradle includes a finger cut out to enhance removal of a needle therefrom.

18. The needle threader of claim 10 wherein said needle cradle is magnetized to aid in holding a needle.

19. A needle threader, which comprises:

(a) a loop support base;

(b) a threading loop connected to said loop support base;

(c) a needle holder base;

(d). a needle cradle located on said needle holder base, said needle cradle being adapted to hold a needle by cradling it so as to receive both ends of the needle;

(e). a loop passage guide located on said needle holder base and intersecting said needle cradle at a predetermined angle, and being biased toward one end of said needle cradle; and, (f). a thread insertion hole located on said needle holder base, adjacent to and connected to said loop passage guide;

said loop support base and said needle holder base being moveably connected to one another so that said threading loop may be inserted into said loop passage guide and extended into said thread insertion hole by movement of said loop support base toward said needle holder base; and, such that a user may insert a needle into said needle cradle with the needle eye located at the intersection of said needle cradle and said loop passage guide, the user may then move said loop support base toward said needle holder base so as to insert said threading loop into said loop passage guide, through said eye of said needle and into said thread insertion hole, the user may then insert thread through said thread insertion hole and through said threading loop, and the user may then move said loop support base away from said needle holder base so as to withdraw said threading loop from said thread insertion hole, from said eye of said needle, and from said loop passage guide so as to thread said needle with said thread.

* * * * *